US006209609B1

(12) United States Patent
Edwards et al.

(10) Patent No.: US 6,209,609 B1
(45) Date of Patent: Apr. 3, 2001

(54) APPARATUS FOR DISPENSING SHEET MATERIAL

(75) Inventors: Toby Edwards; David F. Kreitzer; Dan B. Pool, all of Phoenix; Jeff Mowry, Mesa, all of AZ (US)

(73) Assignee: Equity Earnings Corp, Phoenix, AZ (US)

( * ) Notice: Subject to any disclaimer, the term of this patent is extended or adjusted under 35 U.S.C. 154(b) by 0 days.

(21) Appl. No.: 09/204,435

(22) Filed: Dec. 3, 1998

(51) Int. Cl.[7] ..... B32B 31/00
(52) U.S. Cl. ..... 156/577; 574/579
(58) Field of Search ..... 156/71, 574, 576, 156/577, 579

(56) References Cited

U.S. PATENT DOCUMENTS

| | | | | |
|---|---|---|---|---|
| 3,785,901 | | 1/1974 | Fritzinger . | |
| 3,960,643 | | 6/1976 | Dargitz et al. . | |
| 3,968,001 | | 7/1976 | Lockwood . | |
| 3,969,181 | * | 7/1976 | Seabold | 156/577 |
| 4,003,781 | * | 1/1977 | Holsten | 156/526 |
| 4,086,121 | * | 4/1978 | Ames | 156/526 |
| 4,197,624 | | 4/1980 | Lass . | |
| 4,208,239 | | 6/1980 | Lass . | |
| 4,406,730 | | 9/1983 | Altmix . | |
| 4,652,331 | | 3/1987 | Plasencia . | |
| 4,707,202 | | 11/1987 | Sweeny . | |
| 4,826,557 | | 5/1989 | Fu et al. . | |
| 5,073,228 | | 12/1991 | Lin . | |
| 5,178,717 | * | 1/1993 | Rodriguez | 156/523 |
| 5,342,466 | | 8/1994 | Eidson . | |
| 5,814,184 | | 9/1998 | Denkins . | |

* cited by examiner

*Primary Examiner*—Mark A. Osele
(74) *Attorney, Agent, or Firm*—Parsons & Goltry; Robert A. Parsons; Michael W. Goltry

(57) ABSTRACT

Apparatus for dispensing sheet material comprising a chassis, a drive assembly engagable for movement against a surface for driving sheet material through the chassis, a cutting element carried by the chassis for movement along a cutting path for severing the sheet material, and an extension of the chassis movable between forward and normal rearward positions and having a distal end, wherein the sheet material may be severed to form a free end to terminate adjacent a point corresponding with the distal end of the extension in the forward position.

17 Claims, 15 Drawing Sheets

APPARATUS FOR DISPENSING SHEET MATERIAL

FIELD OF THE INVENTION

This invention relates generally to dispensing apparatus and, more particularly, to improved methods and apparatus for dispensing sheet material.

BACKGROUND OF THE INVENTION

Drywall installation is very labor intensive. In fact, more than half the cost of installing drywall is borne by labor. One of the most labor-intensive steps in drywall installation is the patching of the seams separating adjacent drywall panels. This process normally involves applying a layer of tape over the seams and then sealing the tape with a suitable drywall compound. The application of the tape over the seams proves especially difficult because the seams can prove challenging to reach, and workers find it difficult to cut the tape to desired lengths. Although various devices have been constructed to enhance the ease and efficiency of applying tape to the seams separating adjacent drywall panels, they are difficult to construct and workers find them messy, difficult to clean and cumbersome. These and other disadvantages with known devices therefore necessitate certain new and useful improvements.

Accordingly, it would be highly desirable to provide improved apparatus and methods for dispensing and applying sheet material to a surface and, more particularly, improved apparatus and methods for dispensing and applying tape to a surface.

It is a purpose of the present invention to provide new and improved apparatus for dispensing sheet material that is easy to construct.

It is another purpose of the present invention to provide new and improved apparatus for dispensing sheet material that is easy to use.

It is still another purpose of the present invention to provide new and improved apparatus for dispensing sheet material that is inexpensive.

It is a further purpose of the present invention to provide new and improved apparatus for dispensing sheet material constructed to allow a worker to install precisely measured courses of sheet material.

It is still a further provision of the present invention to enhance the ease and efficiency of patching the seams formed by adjacent drywall panels.

It is yet still a further provision of the present invention to reduce the labor costs associated with drywall installation, It is another purpose of the present invention to provide new and improved apparatus for dispensing sheet material that is easy to clean and maintain.

It is still another purpose of the present invention to provide new and improved apparatus for dispensing sheet material that allows for quick and efficient installation.

It is yet still another provision of the present invention to substantially reduce the labor investment normally associated with patching the seams separating adjacent drywall panels.

SUMMARY OF THE INVENTION

The above problems and others are at least partially solved and the above purposes and others are realized in new and improved apparatus for dispensing and applying sheet material, especially tape, to a surface. In a particular embodiment, apparatus of the present invention is generally comprised of an elongate body with a head assembly supported at one end and a roll of tape supported by the elongate body adjacent the head assembly for rotation. The head assembly includes a chassis with an upstream end directed toward the elongate body and a downstream end directed away from the elongate body. The chassis supports a drive assembly engagable against a surface for receiving, dispensing and applying tape to the surface, a cutting assembly and a measuring assembly for allowing installation of precisely measured courses of tape.

Drive assembly includes an outfeed roller carried by the chassis for rotation and an infeed roller carried by the chassis for rotation spaced from the outfeed roller and drivenly coupled with the outfeed roller, the outfeed and infeed rollers for positively driving sheet material from the infeed roller to the outfeed roller in response to movement of the outfeed roller against a surface. A continuous belt couples the outfeed roller with the infeed roller in driving engagement. The continuous belt is normally supported by a drive pinion carried by the outfeed roller and a driven pinion carried by the infeed roller. A guide roller is also carried by the chassis for rotation against, and in response to rotation of, the infeed roller.

The drive assembly may further include an applicator head engagable for movement against a surface for positively driving sheet material through the drive assembly from the infeed roller to the outfeed roller and for applying the sheet material to a surface in a first position, and stowable in a second position different from the first position. The applicator head is carried for rotation by a framework mounted for movement between the first and second positions of the applicator head. A proximal pinion is supported by the chassis as part of the drive assembly, a distal pinion is carried by the applicator head and an intermediate pinion mounted with the framework in meshing engagement with the distal pinion. The intermediate pinion is engagable in meshing engagement with the proximal pinion in the first position of the applicator head for coupling the applicator head in driving engagement with the outfeed roller.

To sever tape after application to a surface, the present invention provides a cutting assembly including a cutting element carried by the chassis for movement along a cutting path for severing the sheet material and an assembly for moving the cutting element along the cutting path. The assembly comprises a support element or cam wheel carried by the chassis for movement between normal first and second positions for moving the cutting element along the cutting path. The cutting element is normally carried by the cam wheel. Lever apparatus is coupled with the cam wheel for moving it between the normal first and second positions. The lever apparatus comprises a handle mounted for movement in reciprocal directions and a cordage assembly interconnecting the handle with the cam wheel and movable in response to movement of the handle in reciprocal directions for moving the cam wheel between the normal first and second positions. A biasing element mounted with the chassis and the cam wheel normally bias the cam wheel in its normal first position.

To measure precise courses of tape, the invention further includes a measuring assembly. The measuring assembly includes an extension of the chassis movable between forward and normal rearward positions and having a distal end, wherein the tape may be severed to form a free end to terminate adjacent a point corresponding with the distal end of the extension in the forward position. The extension is normally mounted for movement in pivotal directions between its forward and normal rearward positions. A lever assembly may be actuated for moving the extension between the forward and normal rearward positions. The lever assembly includes a lever mounted for movement in pivotal directions and cordage interconnecting the lever with the extension and movable in response to movement of the lever for moving the extension between the forward and normal rearward positions. A biasing element mounted with the chassis and the extension normally bias the extension in its normal rearward position.

Consistent with the foregoing, associated methods may also be provided.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

The present invention provides, among other things, new and improved apparatus and methods for dispensing and applying sheet material, especially tape, to a surface. Ensuing embodiments of the invention are easy to construct and use, and prove particularly useful for the quick and efficient installation of tape over seams separating adjacent drywall panels.

Figure 1:
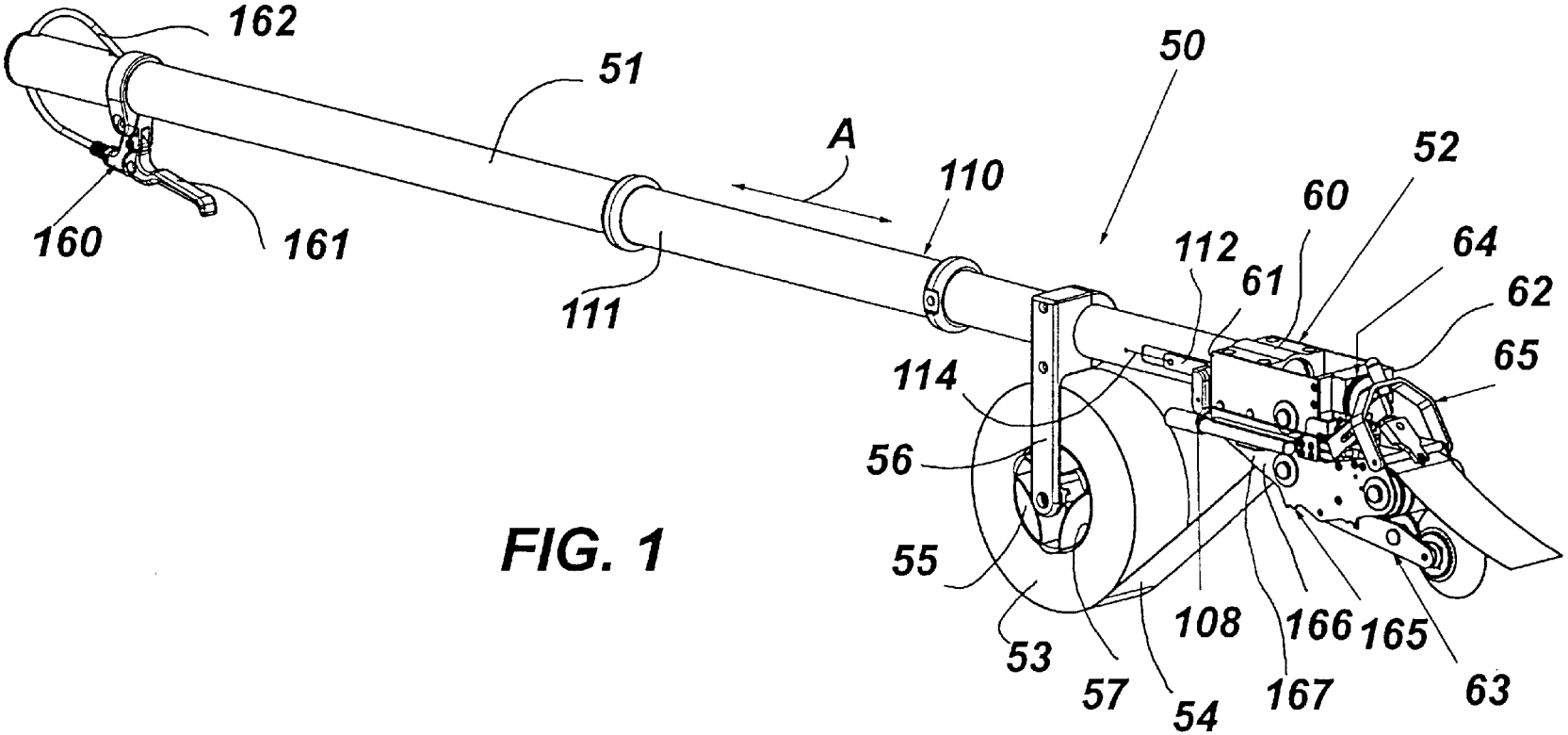
FIG. 1 is an isometric view of apparatus for dispensing sheet material comprising an elongate body and a head assembly carried by the elongate body for receiving and dispensing sheet material carried by a roll.
Figure 2:
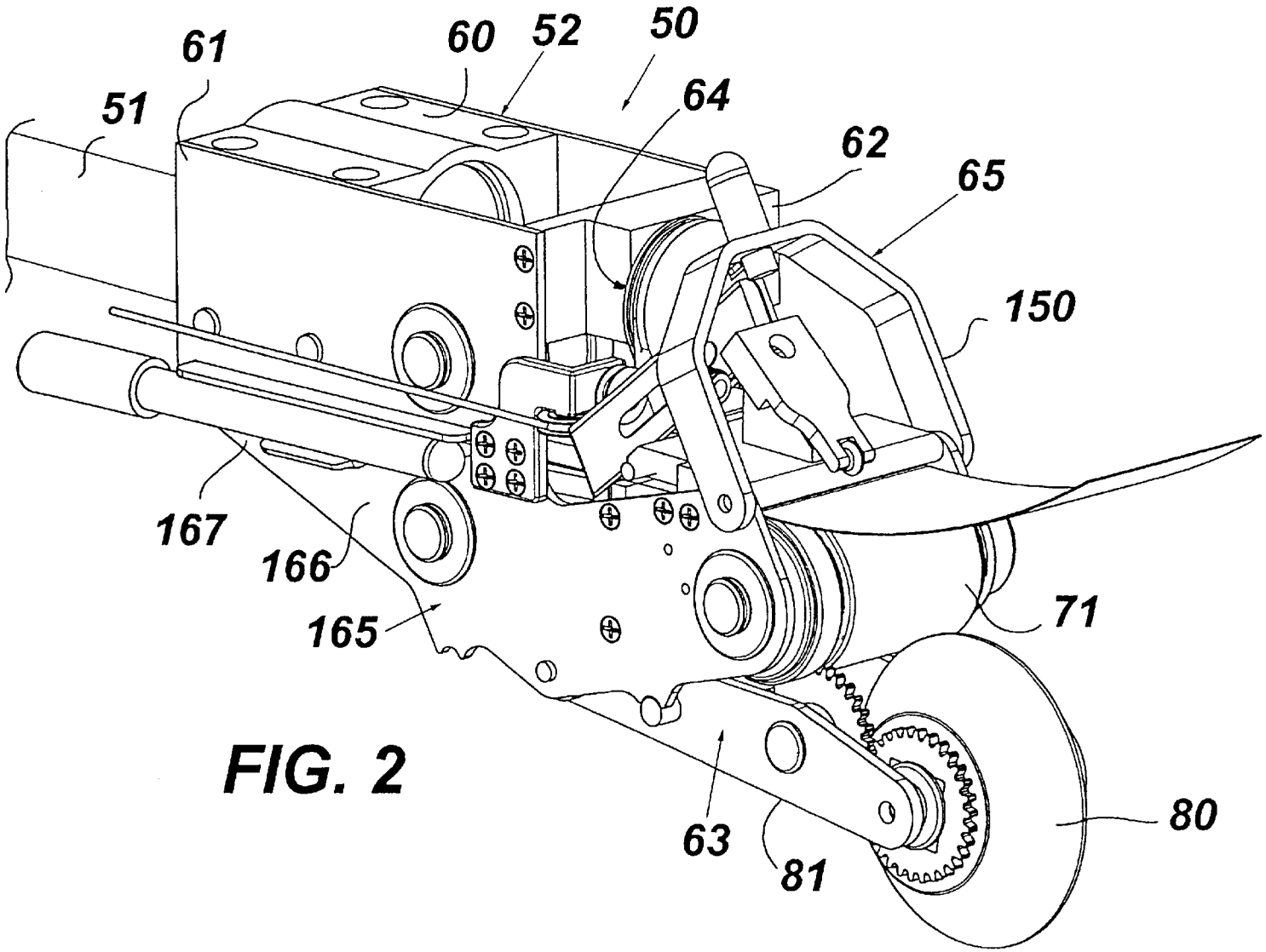
FIG. 2 is an enlarged view of the head assembly of FIG. 1.

Turning now to the drawings, in which like reference characters indicate corresponding elements throughout the several views, attention is first directed to FIG. 1 illustrating an isometric view of apparatus 50 for dispensing and applying sheet material, such as tape, to a surface. Apparatus 50 is a hand held device and is generally comprised of an elongate body 51 with a head assembly 52 supported at one end and a roll 53 of tape 54 supported adjacent head assembly 52 for rotation. Referring also to FIG. 2, head assembly 52 includes a chassis 60 with an upstream end 61 directed toward elongate body 51 and a downstream end 62 directed away from elongate body 51. Chassis 60 supports a drive assembly 63 engagable against a surface for receiving, dispensing and applying tape 54 to the surface, a cutting assembly 64 and a measuring assembly 65 for allowing installation of precisely measured courses of tape 54. To support roll 53 of tape 54 for rotation normally upstream of head assembly 52, apparatus 50 includes a wheel 55 supported for rotation by an arm 56 depending from elongate body 51. Wheel 55 is sized for engaging the core 57 of roll 53. In this regard, a user may insert wheel 55 into the core 57 for detachably capturing roll 53 for rotation.

For ease of discussion, drive assembly 63 will be discussed in §I, cutting assembly 64 will be discussed in §II and measuring assembly 65 will be discussed in §III.

§I. THE DRIVE ASSEMBLY

Figure 3:
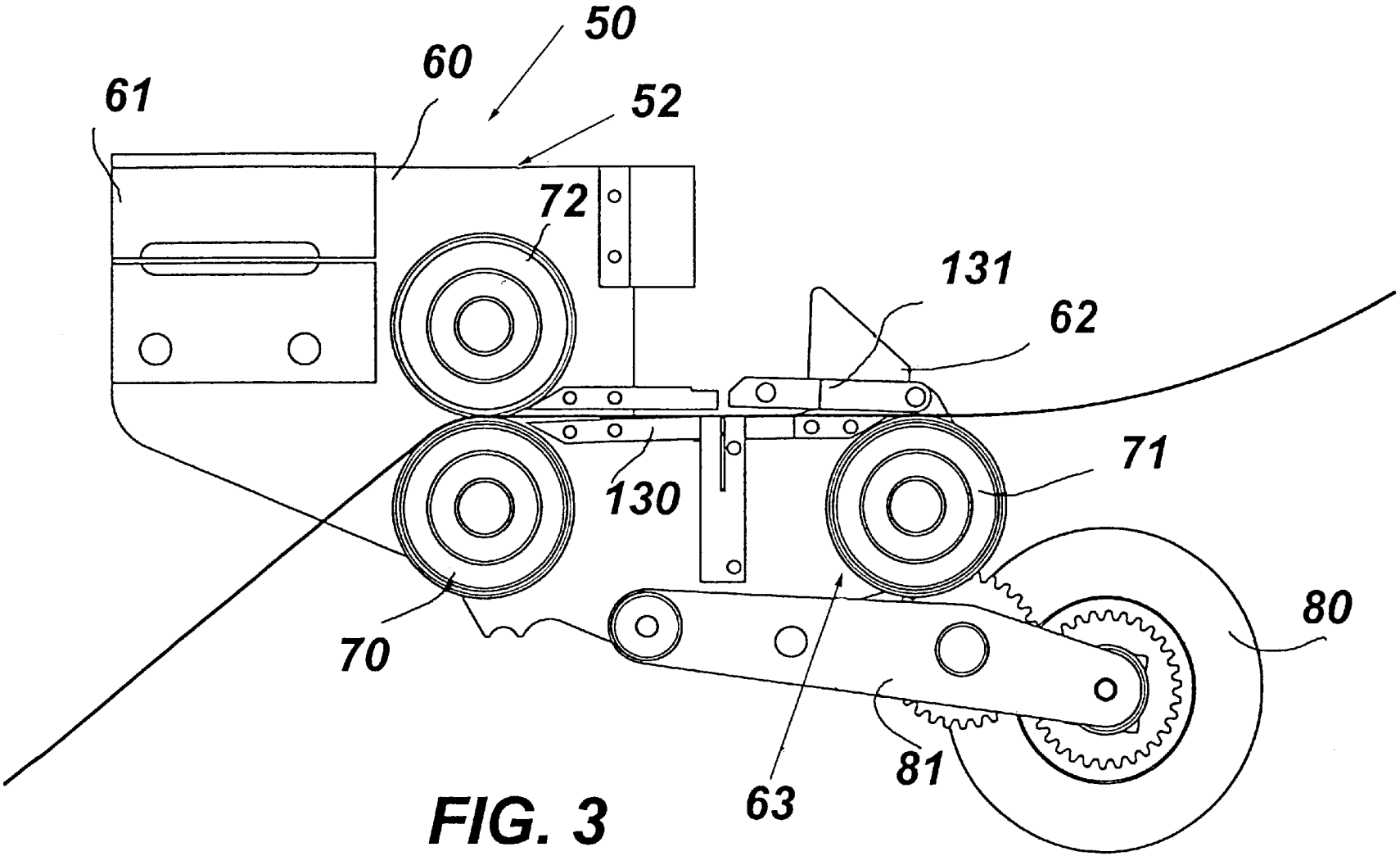
FIG. 3 is a vertical sectional view of the head assembly of FIG. 2 with sheet material shown as it would appear feeding through a drive assembly.

Drive assembly 63 is operative for receiving, dispensing and applying tape 54 to a surface in a direction from upstream end 61 to downstream end 62. Referring to FIG. 3 illustrating a vertical sectional view of head assembly 52, drive assembly 63 is generally comprised of an infeed roller 70 carried by chassis 60 adjacent upstream end 61 for rotation and an outfeed roller 71 carried by chassis 60 adjacent downstream end 62 for rotation. Also included is a guide roller 72 carried by chassis 60 adjacent upstream end 61 for rotation against, and in response to rotation of, infeed roller 70. Infeed, outfeed and guide rollers, 70, 71 and 72, are captured by chassis 60 for rotation at their free ends and rotate about axes each substantially perpendicular to the direction tape 54 travels through drive assembly 63 from infeed roller 70 to outfeed roller 71.

Figure 5:
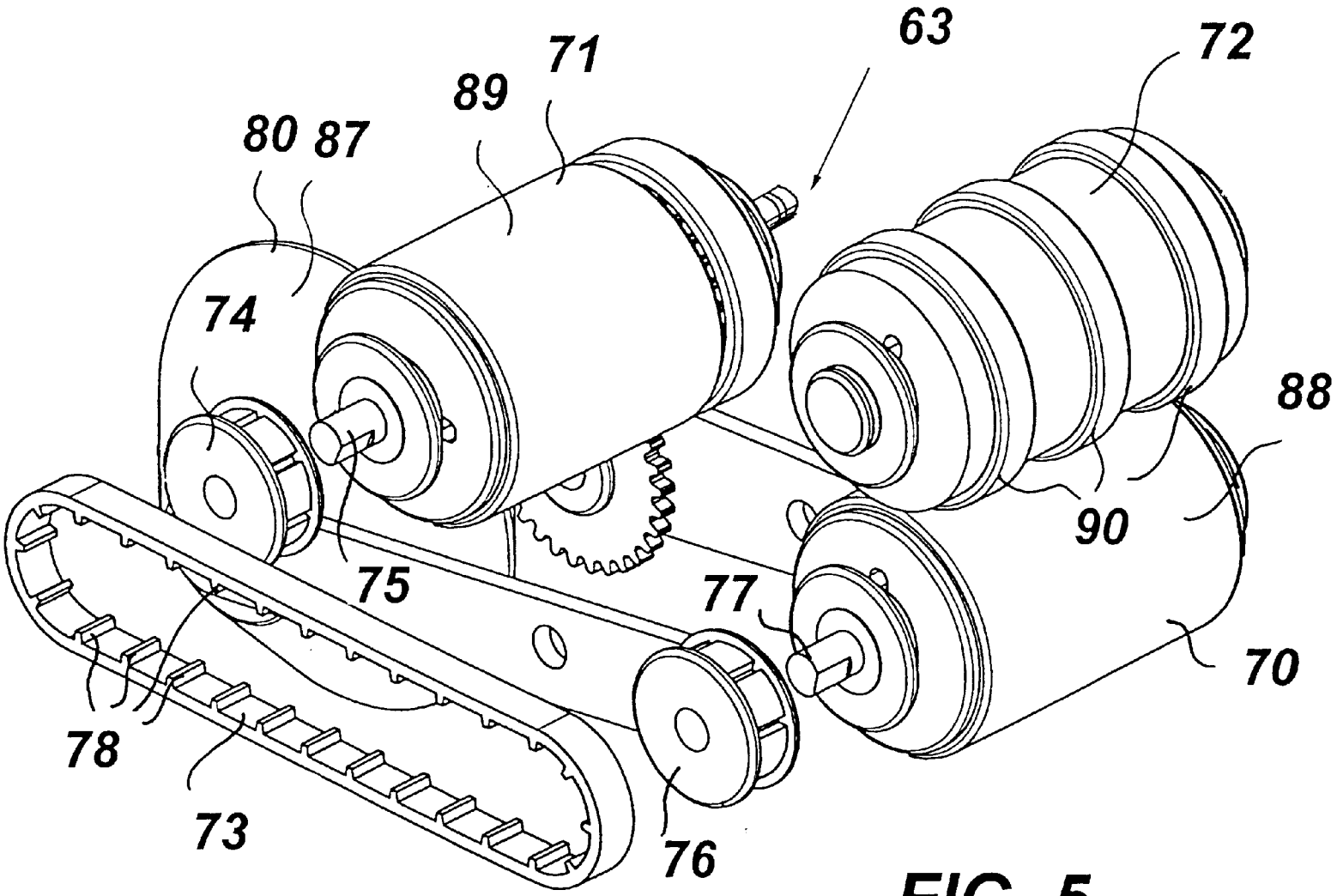
FIG. 5 is an exploded isometric view of the drive assembly of FIG. 3.

Infeed roller 70 is drivenly coupled to outfeed roller 70 with, as shown in FIG. 5, a continuous belt 73. In this specific embodiment, continuous belt 73 is supported by a drive pinion 74 carried by a free end 75 of outfeed roller 71 and a driven pinion 76 carried by a free end 77 of infeed roller 70. Continuous belt 73 carries teeth 78 at spaced intervals for meshing engagement with the drive and driven pinions 74 and 76.

Figure 16:
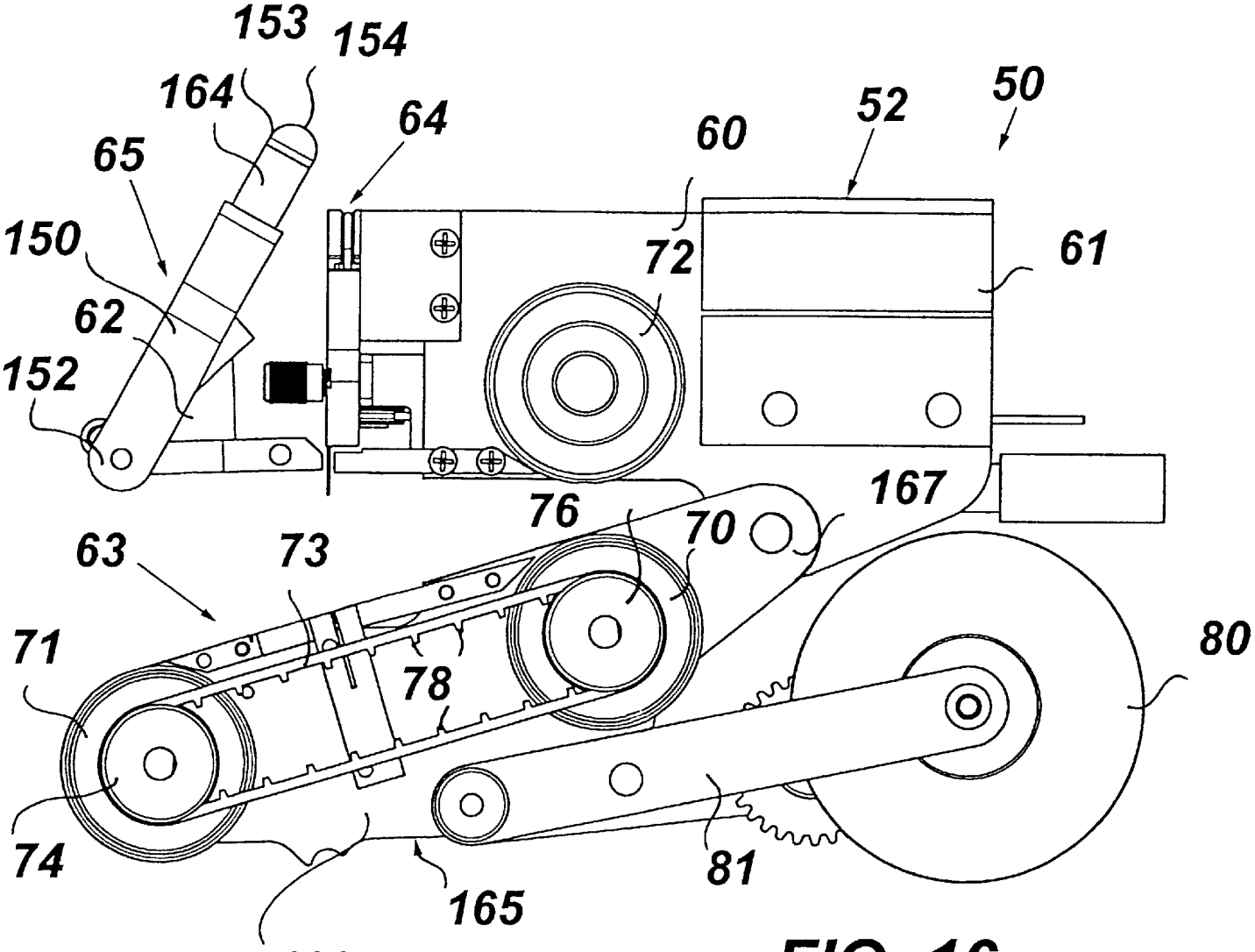
FIG. 16 is a vertical sectional view of the head assembly of FIG. 1 showing the drive assembly of FIG. 3 as it would appear in an open position.

Turning back to FIG. 3, drive assembly 63 further includes an applicator head 80. Applicator head 80 is carried by a framework 81 for rotation about an axis substantially parallel to each one of the axes of rotation of infeed, outfeed and guide rollers, 70, 71 and 72. Framework 81 is mounted with chassis 60 for movement in pivotal directions at an end thereof between a first position of applicator head 80 adjacent and somewhat downstream of outfeed roller 71 and a second position of applicator head 80 adjacent upstream end 61 of chassis 60 spaced from outfeed roller 71 as shown in FIG. 16 for stowage when not in use. In its first position, applicator head 80 is coupled in driving engagement with outfeed roller 71.

Figure 6:
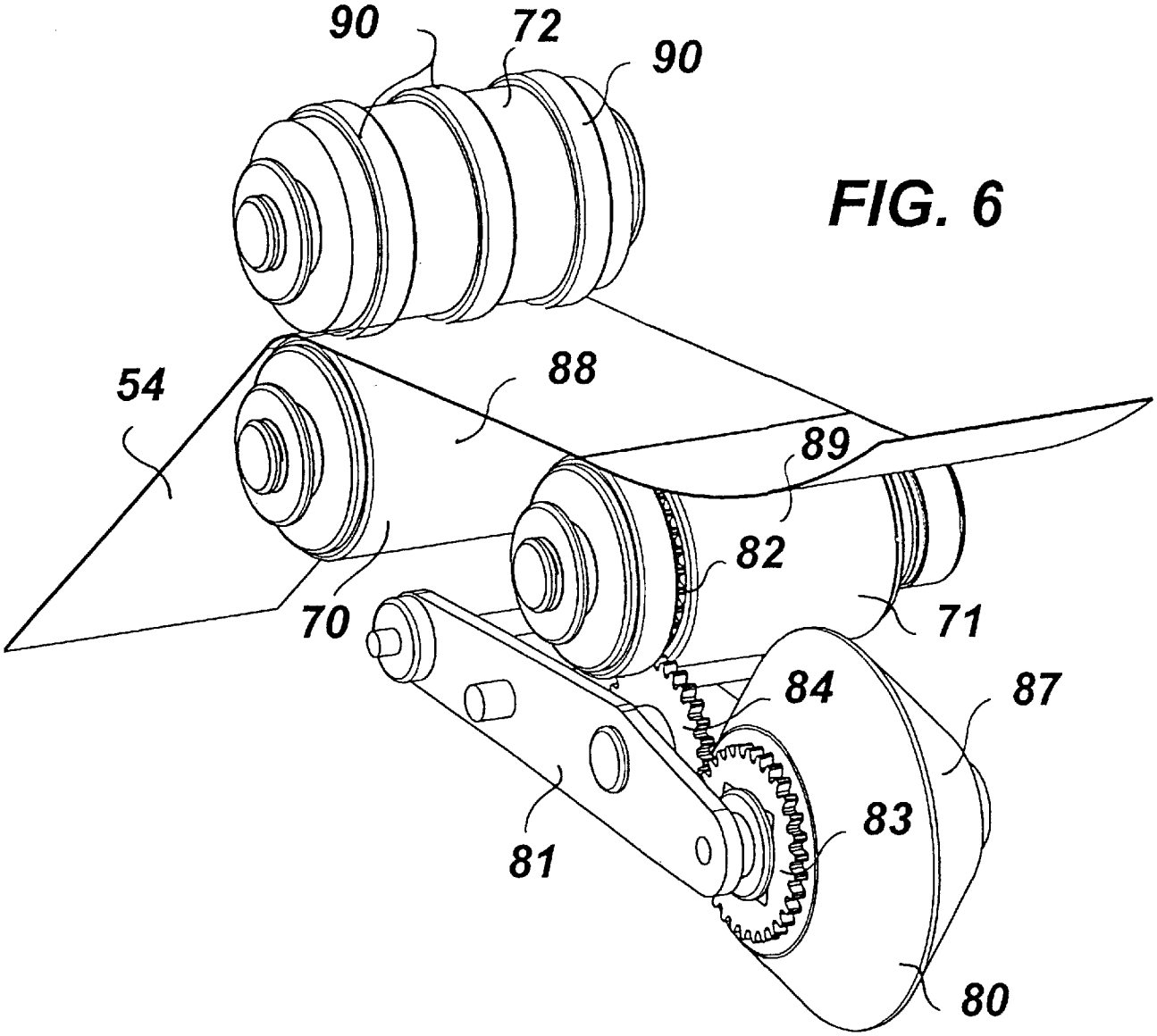
FIG. 6 is a schematic isometric view of the drive assembly of FIG. 3.
Figure 7:
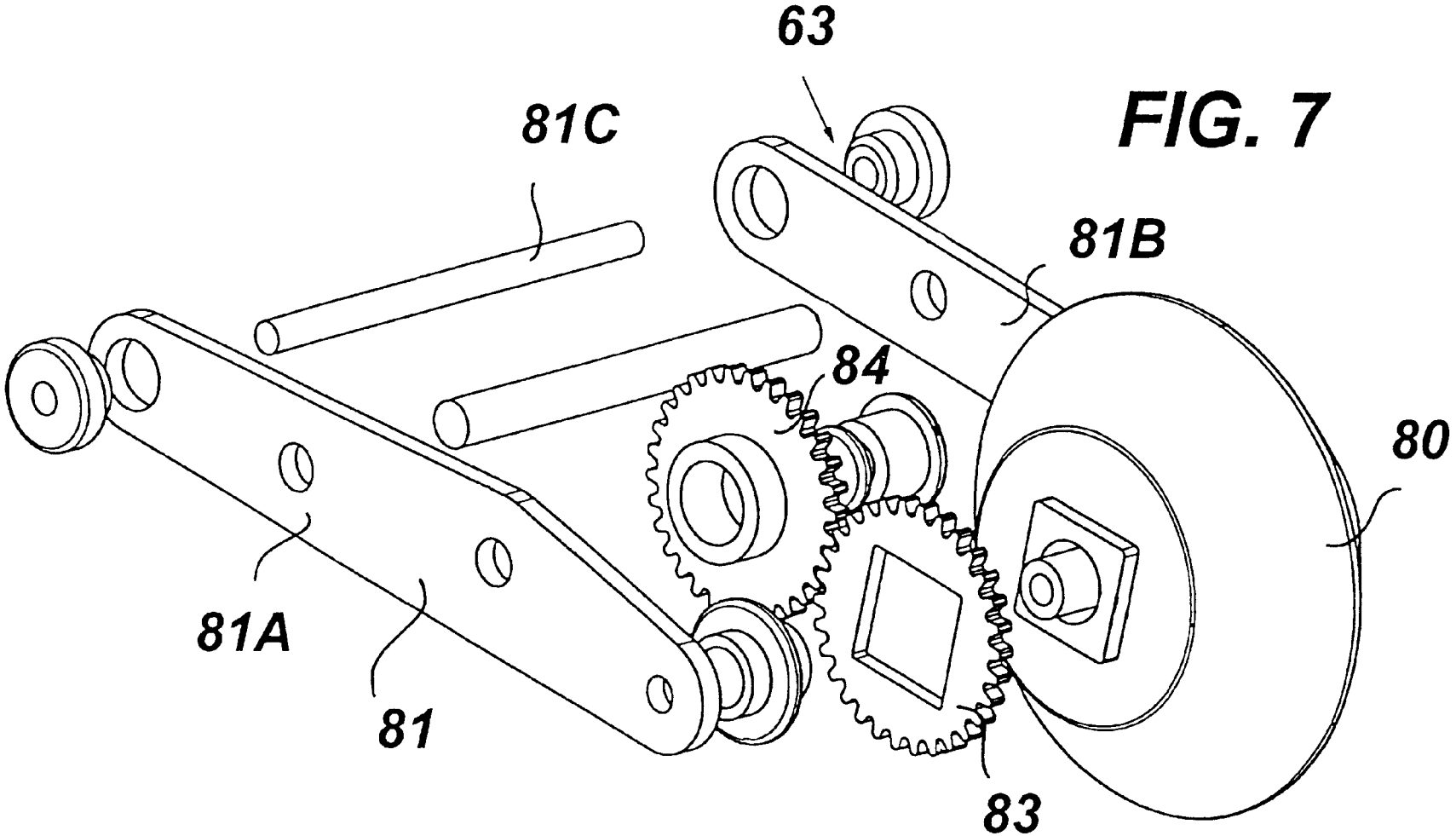
FIG. 7 is another exploded isometric view of the drive assembly of FIG. 3.

Regarding FIG. 7, framework 81 comprises first and second substantially coextensive supporting arms 81A and 81B captured by chassis 60 at ends thereof for pivotal movement about an axle 81C. As shown in FIGS. 6 and 7, outfeed roller 71 substantially rigidly carries a proximal pinion 82 (not shown in FIG. 7) at a somewhat intermediate location, applicator head 80 substantially rigidly carries a distal pinion 83 and framework 81 carries an intermediate pinion 84 for rotation. Proximal, intermediate and distal pinions, 82, 84 and 83, are positioned such that in the first position of applicator head 80 will meshingly engage in series.

Figure 12:
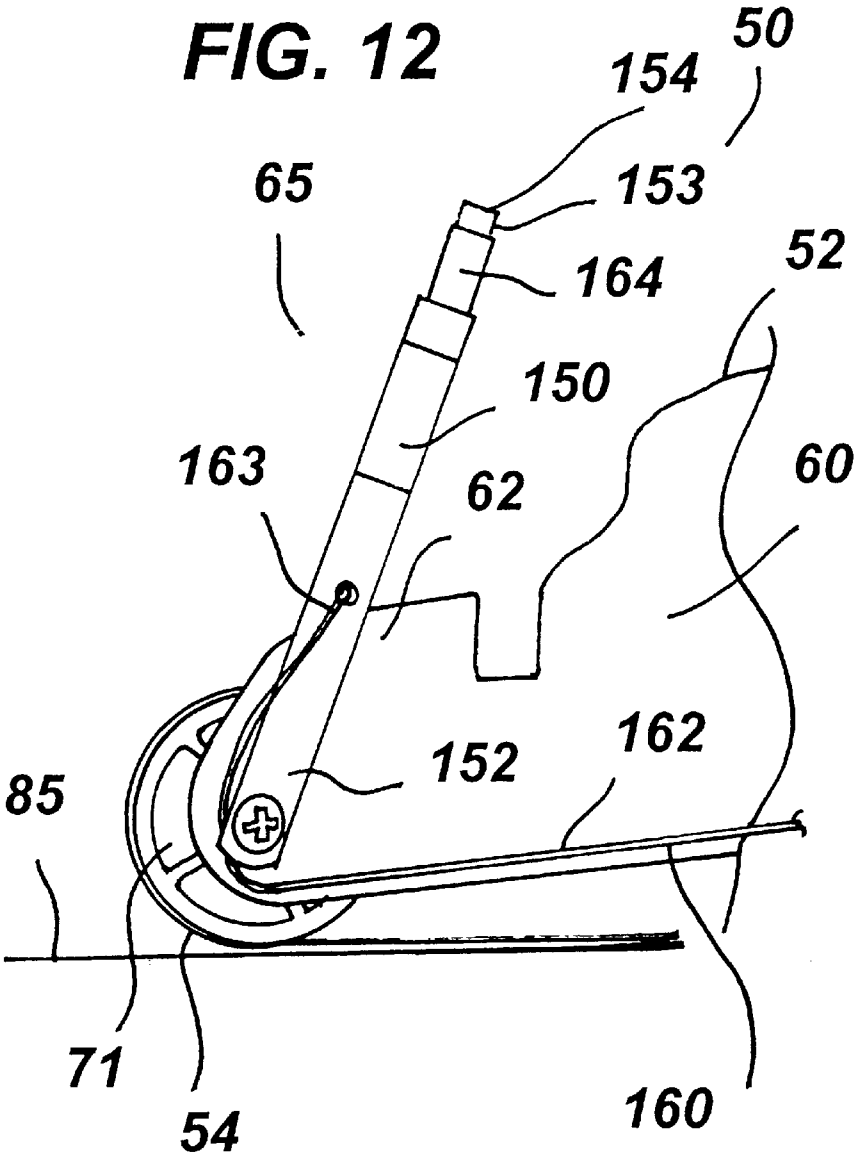
FIG. 12 is a fragmented side elevational view of the head assembly of FIG. 11.

In a first mode of operation, a user may feed a free end of tape 54 between the infeed and guide rollers, 70 and 72, to capture tape 54 by the infeed and guide rollers, 70 and 72. For normal operation, it is desirable for the adhesive side of tape 54 to face guide roller 72. At this point, a user may grasp elongate body 51 and, with framework 81 in the second position of applicator head 80, engage and move outfeed roller 71 for rotation against a surface in a direction leading with outfeed roller 71. Because outfeed roller 71 is coupled with infeed roller 70 in driving engagement, as the user moves outfeed roller 71 against a surface for rotation, outfeed and infeed rollers, 70 and 71, cooperate to positively drive tape 54 through drive assembly 63 from infeed roller 70 to outfeed roller 71. To apply tape 54 to a surface, the user may wrap the non-adhesive side of tape 54 around outfeed roller 71 and by bearing and moving outfeed roller 71 against the surface leading with outfeed roller 71, positively drive tape 54 through drive assembly 63 and force the adhesive side of tape 54 against surface 85 for application as shown substantially in FIG. 12.

In a second mode of operation, a user may feed a free end of tape 54 between the infeed and guide rollers, 70 and 72, to capture tape 54 by the infeed and guide rollers, 70 and 72 as previously mentioned. At this point, a user may grasp elongate body 51 and, with framework 81 in the first position of applicator head 80, engage and move applicator head 80 against a surface in a direction leading with applicator head 80. Because the proximal, intermediate and distal pinions, 82, 84 and 83, meshingly engage in series with framework 81 in the first position of applicator head 80, applicator head 80 is coupled with outfeed roller 71 in driving engagement. Therefore, as the user moves applicator head 80 against a surface for rotation, applicator head 80, outfeed roller 71 and infeed roller 70 cooperate to positively drive tape 54 through drive assembly 63 from infeed roller 70 to outfeed roller 71. It will be readily understood that because the proximal and distal pinions, 82 and 83, are separated by a single pinion, the proximal and distal pinions, 82 and 83, will rotate in the same direction a the user bears and moves applicator head 80 against a surface for rotation. It will also be understood that the proximal and distal pinions, 82 and 83, need only be separated in meshing engagement via an odd number of pinions for them to rotate in the same direction.

Figure 13:
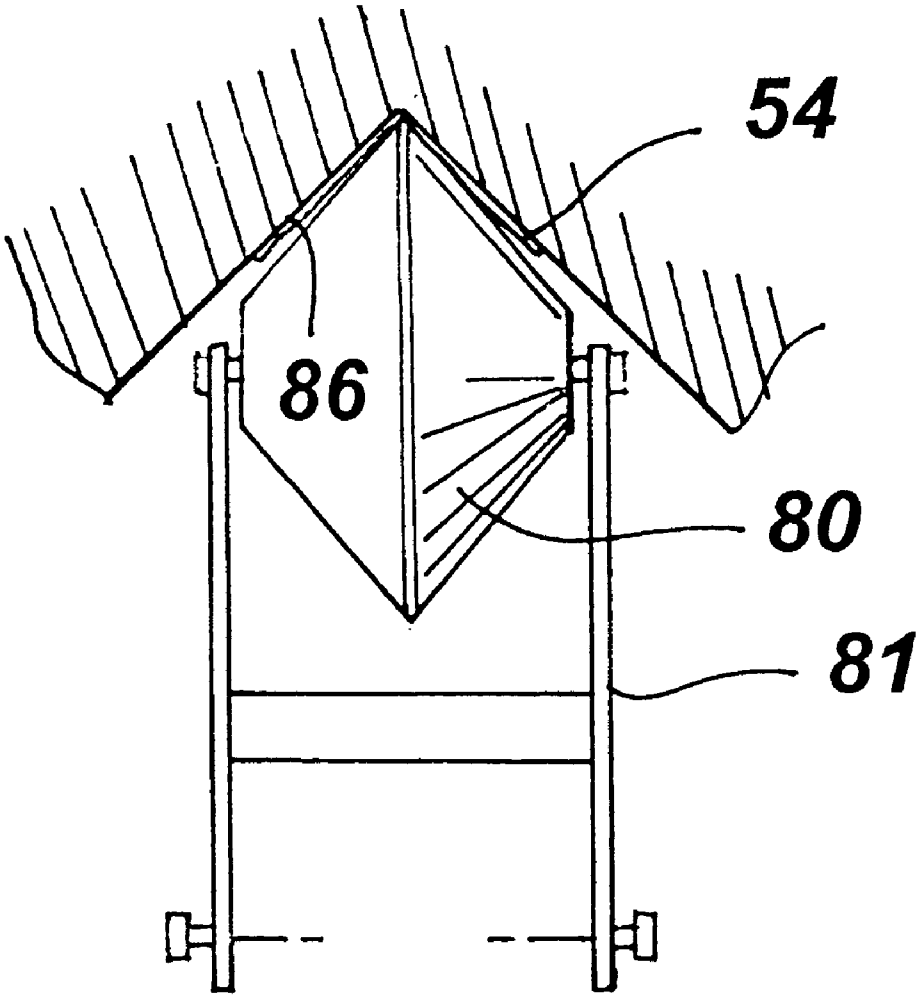
FIG. 13 is a plan view of an applicator head of the drive assembly of FIG. 2.

To apply tape 54 to a surface in the second mode of operation of apparatus 50, the user may wrap the nonadhesive side of tape 54 around applicator head 80 and by bearing and moving applicator head 80 against a surface leading with applicator head 80, positively drive tape 54 through drive assembly 63 and force the adhesive side of tape 54 against surface 86 for application as shown substantially in FIG. 13. Surface 86 is provided as a corner and applicator head 80 shaped for generally conforming with the corner as it rotates to allow for the easy installation of tape 54 into the corner. Those of ordinary skill will appreciate that applicator head 80 may take on variety of shapes and dimensions as needed for tape-to-surface application.

For proper operation, it is important to prevent tape 54 from sticking against the applicator head 80 and the infeed, guide and outfeed rollers, 70, 71 and 72. To prevent sticking, and with momentary attention directed back to FIGS. 5 and 6, the outer surface of applicator head 80 comprises a non-stick elastomeric surface 87, the outer surfaces of infeed and outfeed rollers, 70 and 71, comprises non-stick elastomeric surfaces, 88 and 89, respectively, and the outer surface of guide roller 72 is defined by a plurality of non-stick elastomeric bands 90. Other suitable non-stick surfaces may be used if desired.

§II. THE CUTTING ASSEMBLY

Figure 14:
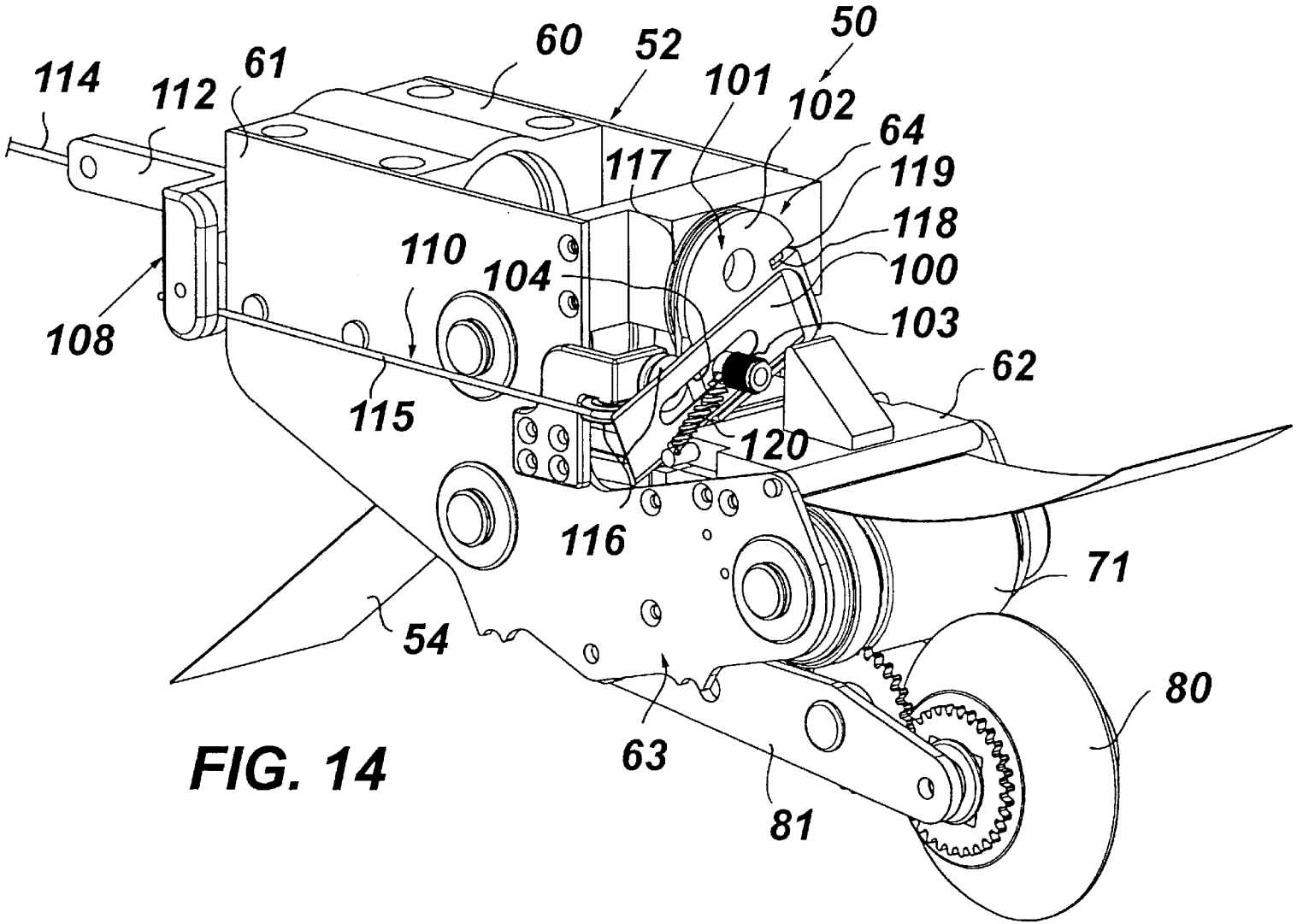
FIG. 14 is an enlarged isometric view of the head assembly of FIG. 1 showing a cutting assembly for severing sheet material.
Figure 15:
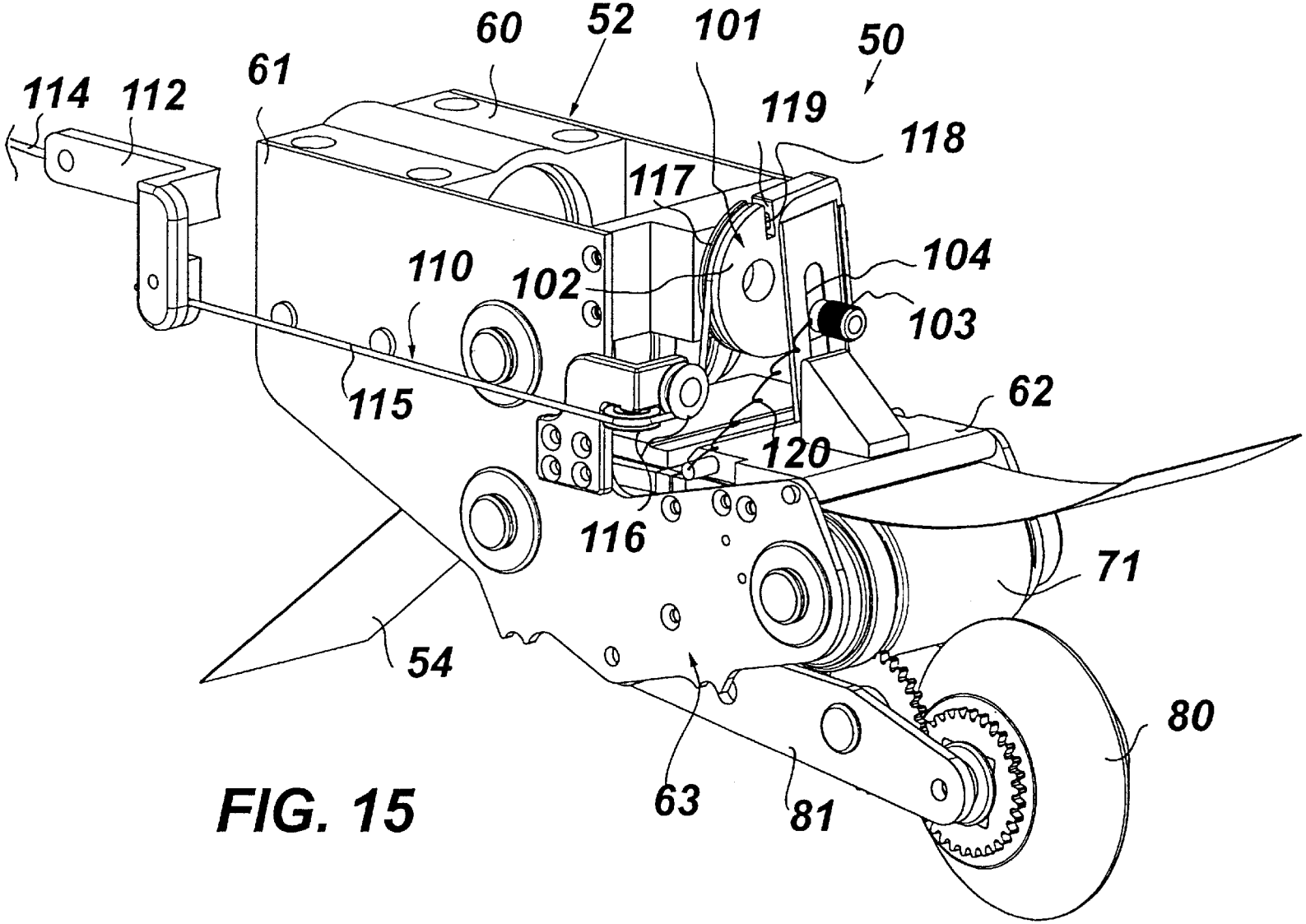
FIG. 15 is a view very similar to the view of FIG. 11.

When a desired length or course of tape 54 has been dispensed and applied to a surface, the user may sever tape 54 with cutting assembly 64. With attention directed to FIG. 14, cutting assembly 64 comprises a cutting element or blade 100 supported for movement along a cutting path for severing tape 54 and an assembly 101 for moving cutting element 100 along the cutting path. In this specific embodiment, assembly 100 comprises a supporting element comprising, in this specific example, a cam wheel 102 carried by chassis 60 for rotation intermediate the infeed and outfeed rollers, 70 and 71, for movement between normal first and second positions. Cutting element 100 is captured against cam wheel 102 with a nut 103 that extends through a groove 104 of cutting element 100 and into cam wheel 102 for threaded engagement. In the normal first position of cam wheel 102, cutting element 100 extends outwardly and resides along one side of tape 54. Assembly 101 further includes lever apparatus 110 coupled with cam wheel 102 that may be actuated for moving cam wheel 102 between its normal first position in FIG. 14 and its second position in FIG. 15 for moving cutting element 100 along the cutting path for severing tape 54. The cutting path of cutting element 100 extends transverse to the travel path of tape 54 through drive assembly 63.

Regarding FIG. 1, lever apparatus 110 includes a handle 111 carried by elongate body 51 spaced from head assembly 52 for movement in reciprocal directions relative head assembly 52 as generally indicated by the double arrowed line A. Handle 111 is coupled with cam wheel 102 via a cordage assembly generally indicated by the reference character 108. Cordage assembly 108 includes a connector 112 and cordages 114 and 115. Connector 112 is supported by elongate body 51 adjacent upstream end 61 of head assembly for movement in reciprocal directions relative upstream end 61. Handle 111 is coupled with connector via cordage 114 which is partially contained by elongate body 51. Turning back to FIG. 14, connector 112 is in turn coupled with cam wheel 102 via cordage 115. Cordage 115 extends from cam wheel 102 to wheels 116 supported by chassis 60 for rotation that cooperate to constrain and direct cordage 115 toward cam wheel 102. Cordage 115 extends from wheels 116 into a groove 117 of cam wheel 102 and terminates with an enlarged 11 free end 118 captured by a slot 119 carried by cam wheel 102. A biasing element 120 is also provided having an end captured against cam wheel 102 via nut 103 and an end fixed to chassis 60 for normally biasing cam wheel 102 in the normal first position. In this specific example, biasing element 120 includes a compression spring, although other suitable biasing mechanisms may be used.

To sever tape 54, a user may grasp handle 111 and, from a starting position, move it away from head assembly 52 to cause the cordage assembly 108 interconnecting handle 110 with cam wheel 102 to move. As cordage assembly 108 moves in response to movement of handle 111 in this regard, cam wheel 102 will move in response thereto from its normal first position in FIG. 14 to its second position in FIG. 15 to move cutting element 100 along the cutting path to sever tape 54. Once severed, the user may then move handle 111 toward head assembly 52 into its starting position with biasing element 120 operative for biasing cam wheel 102 back to its normal first position.

Figure 4:
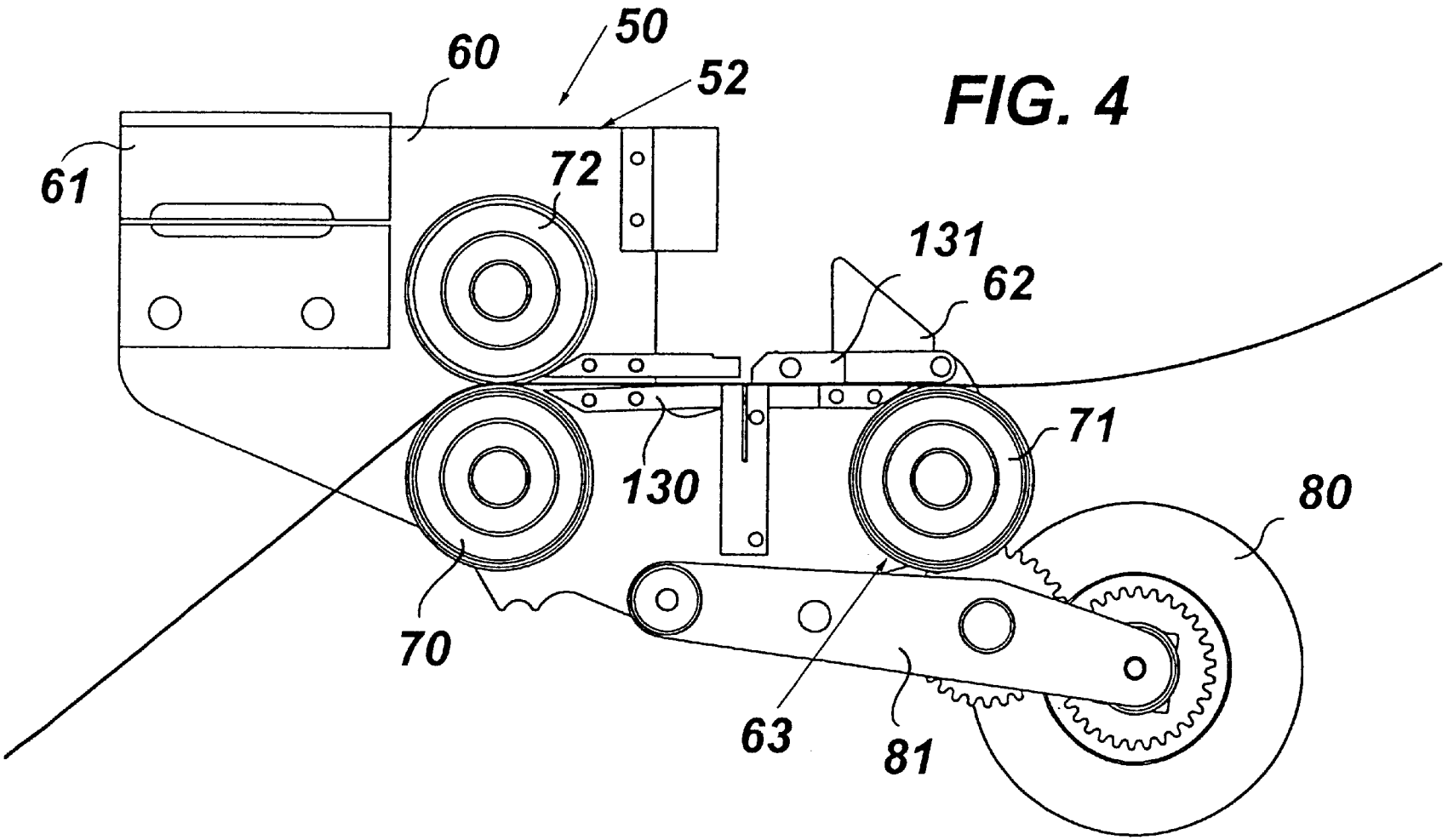
FIG. 4 is a view very similar to the view of FIG. 3.

As tape 54 is driven through drive assembly 63 from infeed roller 70 to outfeed roller 71, it rides upon a base plate 130 supported by chassis 60 intermediate the infeed roller 70 and the outfeed roller 71. Regarding FIGS. 3 and 4, a pinch plate 131 is mounted with chassis 60 toward the outfeed roller 71 in opposition to base plate 130 between which tape 54 travels. Upon actuation of handle 111 to sever tape 54, pinch plate 131 moves in response to capture and secure tape 54 in a pinched condition (FIG. 4) against base plate 130 to prevent tape 54 from buckling or jamming the drive assembly 63 during, or as a result of, the cutting operation. Upon release of handle 111, pinch plate 131 moves in response to release tape 54 from its pinched condition (FIG. 3). Pinch plate 131 is preferably mounted with chassis for movement in pivotal directions and carries a non-stick surface, such as an elastomeric surface, facing tape 54 to prevent tape 54 from sticking to pinch plate 131.

§III. THE MEASURING ASSEMBLY

Figure 8:
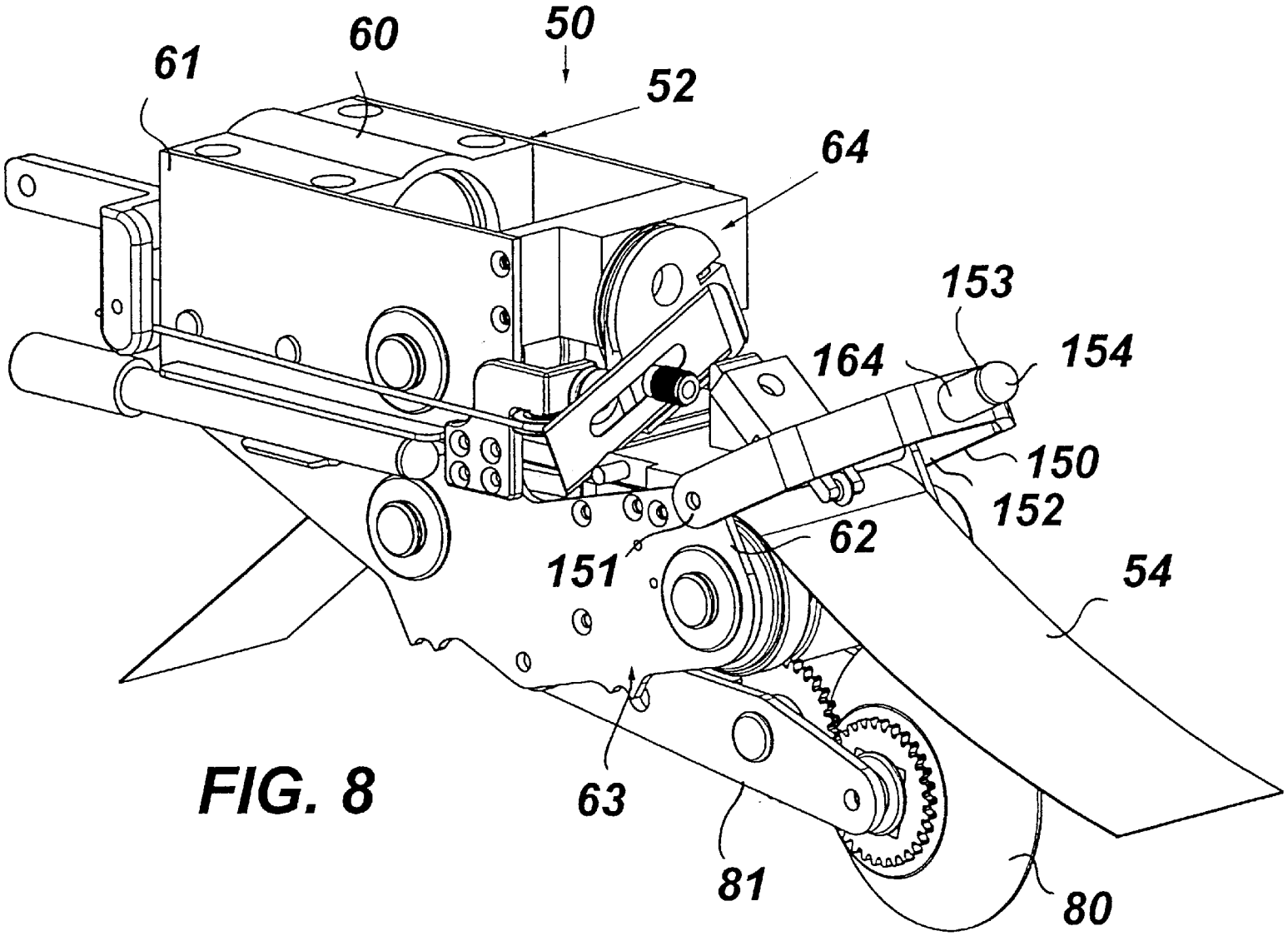
FIG. 8 is an isometric view of the head assembly of FIG. 1 with an extension shown as it would appear in a forward position.
Figure 11:
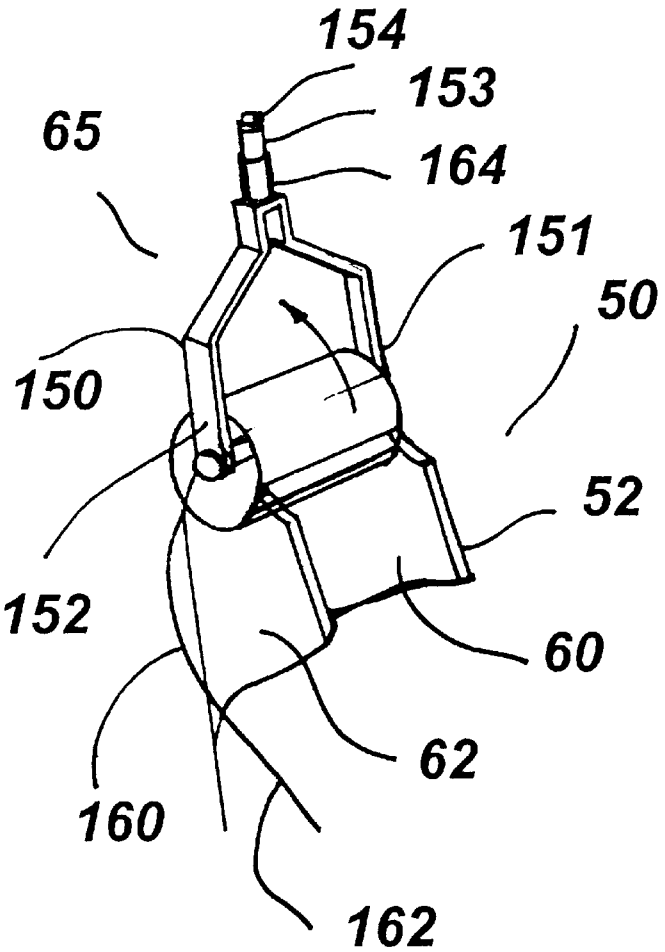
FIG. 11 is a fragmented perspective view of the head assembly of FIG. 10 shown as it would appear applying sheet material to a surface with the other extension shown in the forward position.

During installation, it may be desirable to install precisely measured courses of tape 54 with the use of measuring assembly 65. Turning to FIG. 8, measuring assembly 65 includes an extension 150 supported by chassis 60 adjacent downstream end 62 for movement in pivotal directions between a forward position (also shown in FIG. 11) and a normal rearward position as shown in FIG. 2. Extension 150 is substantially U-shaped and includes free ends 151 and 152 mounted with chassis 60 for pivotal movement. Extension 150 supports, and terminates with, a distal element 153 having an outer or distal end 154.

Regarding FIG. 1, measuring assembly 65 further includes a lever assembly 160 for moving extension 150 between the forward and normal rearward positions. Lever assembly 160 includes a lever 161 mounted with elongate body 51 adjacent a free end thereof spaced from handle 111 for movement in pivotal directions, and cordage 162 interconnecting lever 161 with extension 150. Cordage 162 extends downstream from lever 161, is captured against chassis 60 by free end 152 of extension 150 and terminates with an end 163 fixed to extension 150 intermediate free end 152 and distal element 153. Cordage 162 is movable in response to movement of lever 161 in pivotal directions for moving extension 150 between the forward and normal rearward positions. A biasing element 164 interconnecting extension 150 with chassis 60 upstream of extension 150 operates for biasing extension 150 in its normal rearward position. In this specific example, biasing element 164 is shown as a compression spring, although other biasing mechanisms may be used.

During use of apparatus 50 for applying a course of tape 54 to a surface, a user may decide to terminate the course of tape 54 at a specific point. By moving lever 161, the user may move extension 150 into the forward position and orient distal end 154 adjacent a desired termination point. At this point, the user may sever the tape 54 to form an end of the course and, by normally moving drive assembly 63 against the surface, complete the installation of the course of tape 54 with the end of the course to terminate at the termination point corresponding with the distal end 154.

Figure 9:
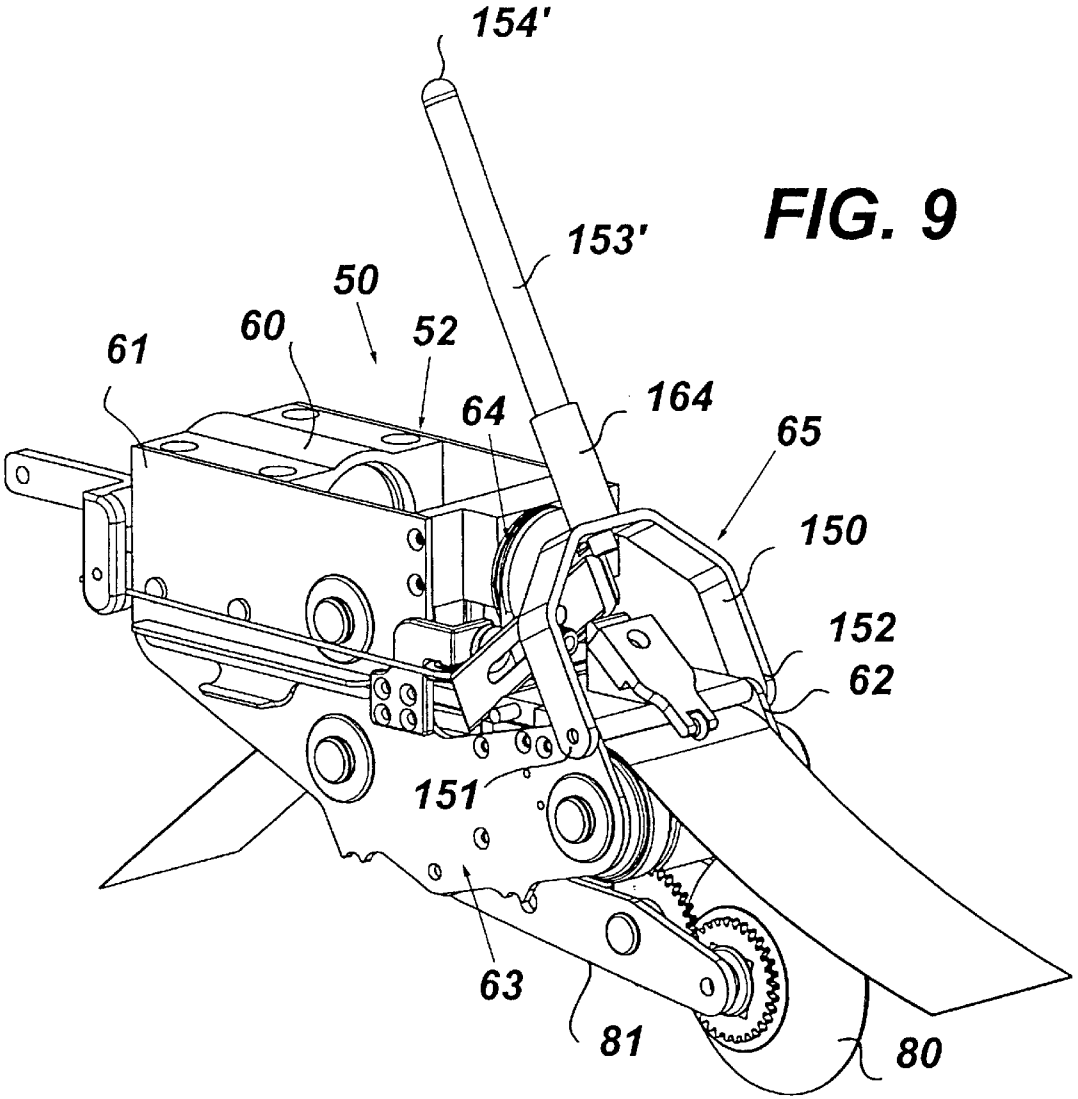
FIG. 9 is an isometric view very similar to the view of FIG. 8 showing another embodiment of an extension shown as it would appear in a rearward position.
Figure 10:
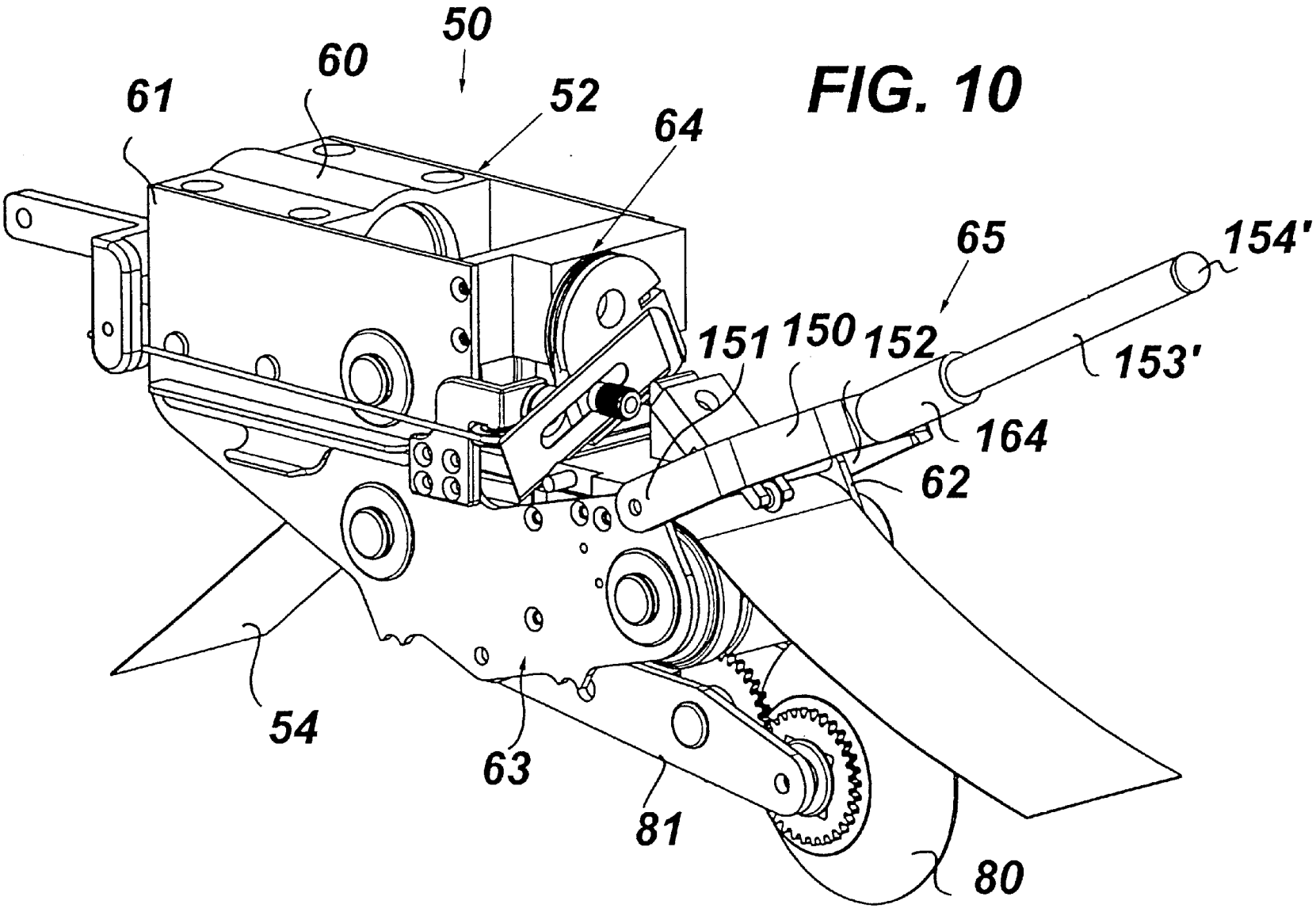
FIG. 10 is an isometric view very similar to the view of FIG. 9 showing the other extension as it would appear in a forward position.

When using outfeed roller 71 to force and apply tape 54 against a surface, distal element 153 may be constructed of a length such that with extension 150 in the forward position, placement of distal end 154 at a desired termination point will ensure that when tape 54 is severed to form a free end, the free end of the tape will terminate at the desired termination point. When using applicator head 80 to force and apply tape 54 against a surface, extension 150 may be provided with a distal element 153' (FIGS. 9 and 10) constructed of a length as substantially shown such that with extension 150 in the forward position, placement of distal end 154' at a desired termination point will ensure that when tape 54 is severed to form a free end, the free end of the tape will terminate at the desired termination point. Distal elements 153 and 153' are designed to be interchangeable and, as a result, detachably receivable by a socket 164 carried by extension. Furthermore, because applicator head 80 extends downstream of outfeed roller 71 in its first position, distal element 153' is constructed to be somewhat longer than distal element 153.

The present invention has been described above with reference to a preferred embodiment. However, those skilled in the art will recognize that changes and modifications may be made in the described embodiments without departing from the nature and scope of the present invention. For instance, FIG. 16 illustrates the drive assembly 63 shown supported by a pivotal extension 165 of chassis 60. Pivotal extension 165 is comprised of a body 166 that captures and supports drive assembly 63 and which is mounted for movement in pivotal directions at an end 167 directed toward upstream end 61 between an open position as shown and a normal closed position as easily seen in FIGS. 1, 2. In the closed position, apparatus 50 may be used normally for applying tape 54 to a surface. In the open position in FIG. 16, drive assembly 63 may be easily accessed for maintenance and cleaning. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Apparatus for dispensing sheet material, comprising:

a chassis;

an outfeed roller carried by the chassis for rotation;

an infeed roller carried by the chassis for rotation spaced from the outfeed roller and drivenly coupled with the outfeed roller, the outfeed and infeed rollers for positively driving sheet material from the infeed roller to the outfeed roller in response to movement of the outfeed roller against a surface; and a guide roller carried by the chassis for rotation against, and in response to rotation of, the infeed roller.

2. Apparatus of claim 1, further including a continuous belt coupling the outfeed roller with the infeed roller in driving engagement.

3. Apparatus of claim 1, further including:

a drive pinion carried by the outfeed roller;

a driven pinion carried by the infeed roller; and a continuous belt supported by the drive and driven pinions.

4. Apparatus of claim 3, wherein the continuous belt is meshingly supported by the drive and driven pinions.

5. Apparatus of claim 4, wherein the continuous belt carries teeth for meshingly engaging the drive and driven pinions.

6. Apparatus for dispensing sheet material, comprising:

a chassis; and a drive assembly including an applicator head engagable for movement against a surface for driving sheet material through the drive assembly and for applying the sheet material to a surface in a first position, and stowable in a second position different from the first position, the applicator head is carried by a framework, mounted for rotation and for movement between the first and second positions;

a proximal pinion of the drive assembly;

a distal pinion carried by the applicator head; and an intermediate pinion mounted in meshing engagement with the distal pinion, the intermediate pinion engagable in meshing engagement with the proximal pinion in the first position of the applicator head for coupling the applicator head in driving engagement.

7. Apparatus for dispensing sheet material, comprising:

a chassis;

a drive assembly including an applicator head engagable for movement against a surface for driving sheet material through the drive assembly and for applying the sheet material to a surface in a first position, and stowable in a second position different from the first position;

an outfeed roller carried by the chassis for rotation; and an infeed roller carried by the chassis for rotation spaced from the outfeed roller and drivenly coupled with the outfeed roller, the outfeed and infeed rollers for positively driving sheet material from the infeed roller to the outfeed roller in response to movement of the applicator head against a surface in the first position thereof.

8. Apparatus of claim 7, further including at least one continuous belt coupling the outfeed roller with the infeed roller in driving engagement.

9. Apparatus of claim 7, further including:

a drive pinion carried by the outfeed roller;

a driven pinion carried by the infeed roller; and a continuous belt supported by the drive and driven pinions.

10. Apparatus for dispensing sheet material, comprising:

a chassis; and a drive assembly carried by the chassis for movement between open and closed positions and engagable for movement against a surface for driving sheet material in the closed position.

11. The apparatus of claim 10, wherein the drive assembly is carried by the chassis for movement in pivotal directions between the open and closed positions.

12. Apparatus of claim 10, wherein the drive assembly comprises:

an outfeed roller carried by the chassis for rotation; and an infeed roller carried by the chassis for rotation spaced from the outfeed roller and drivenly coupled with the outfeed roller, the outfeed and infeed rollers for positively driving sheet material from the infeed roller to the outfeed roller in response to movement of the outfeed roller against a surface.

13. Apparatus of claim 12, further including at least one continuous belt coupling the outfeed roller with the infeed roller in driving engagement.

14. Apparatus of claim 12, further including:

a drive pinion carried by the outfeed roller;

a driven pinion carried by the infeed roller; and a continuous belt supported by the drive and driven pinions.

15. The apparatus of claim 10, wherein the drive assembly comprises:

an outfeed roller carried by the chassis for rotation;

an infeed roller carried by the chassis for rotation spaced from the outfeed roller and one of drivenly and drivingly coupled with the outfeed roller; and an applicator head coupled with one of the outfeed and infeed rollers in driving engagement, the applicator head engagable for movement against a surface for driving sheet material through the drive assembly from the infeed roller to the outfeed roller and for receiving and applying the sheet material to a surface.

16. Apparatus of claim 15, wherein the applicator head is supported for rotation.

17. Apparatus of claim 15, further including:

a proximal pinion of the drive assembly;

a distal pinion carried by the applicator head; and an intermediate pinion mounted in meshing engagement with the distal and proximal pinions.

* * * * *